United States Patent [19]

Zapf

[11] Patent Number: 5,018,791

[45] Date of Patent: May 28, 1991

[54] SEATING FURNITURE

[76] Inventor: Otto Zapf, Herzog-Adolph-Str. 5, D-6240 Konigstein, Fed. Rep. of Germany

[21] Appl. No.: 389,225

[22] Filed: Aug. 3, 1989

[30] Foreign Application Priority Data

Mar. 8, 1988 [DE] Fed. Rep. of Germany ..... 3826290

[51] Int. Cl.[5] ..... A47C 7/02

[52] U.S. Cl. ..... 297/460; 297/452

[58] Field of Search ..... 297/452, 457, 460

[56] References Cited

U.S. PATENT DOCUMENTS 2,833,340 5/1958 Shapiro ..... 297/460 X
4,368,917 1/1983 Urai ..... 297/452
4,753,482 6/1988 Warren ..... 297/460 X
4,911,502 3/1990 Gorman ..... 297/460

FOREIGN PATENT DOCUMENTS 496393 7/1954 Italy ..... 297/460

*Primary Examiner*—Peter A. Aschenbrenner
*Attorney, Agent, or Firm*—Oldham & Oldham Co.

[57] ABSTRACT

There is described a seat construction or seating furniture having a back rest which is pivotable around a horizontal axis approximately at the height of an armrest. At approximately the height of the pivoting axis, the backrest is bent in such a way that the upper and the lower part of the back rest are inclined to each other. Moreover, the back rest is more flexible above and below the pivoting axis and more arched to the rear, respectively.

5 Claims, 4 Drawing Sheets

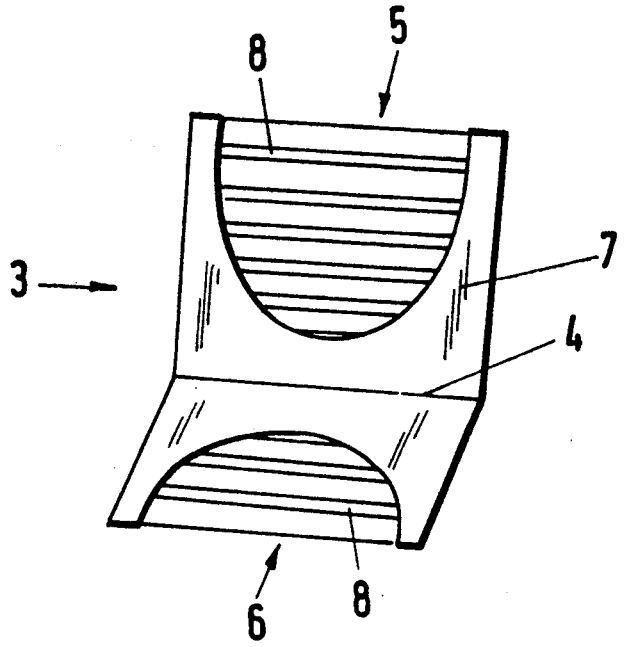
Fig.3
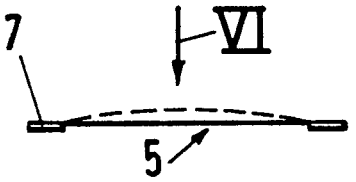
Fig.6
Fig.4
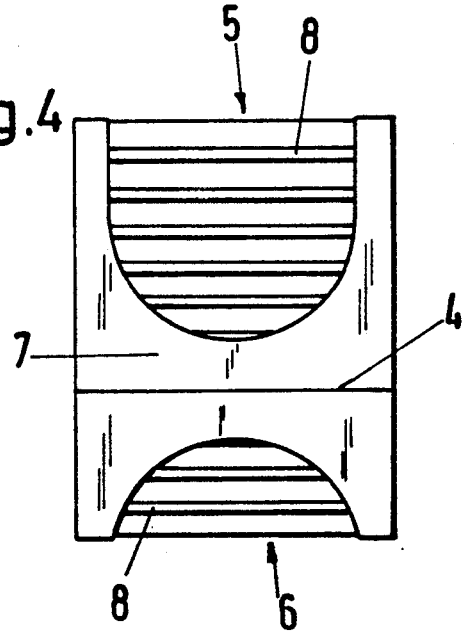
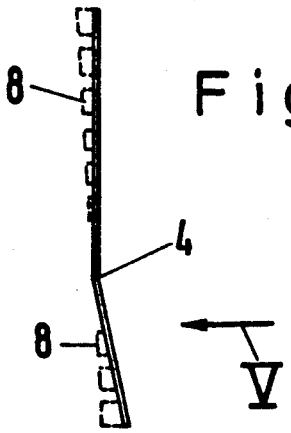
Fig.5
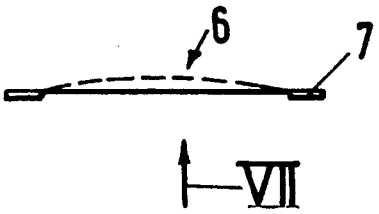
Fig.7

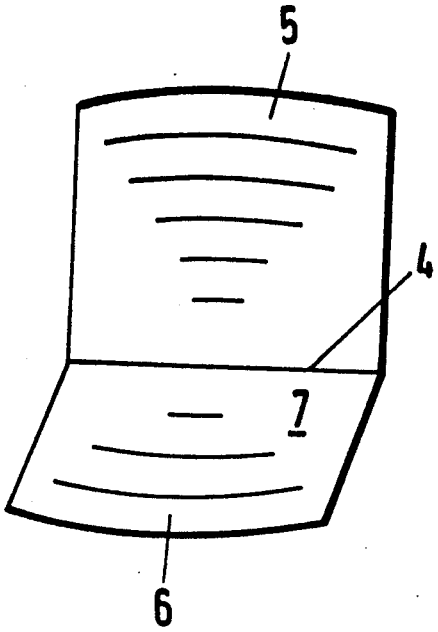
Fig.8
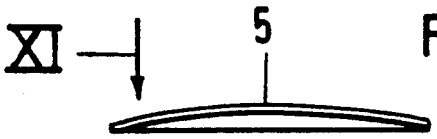
Fig.11
Fig.9
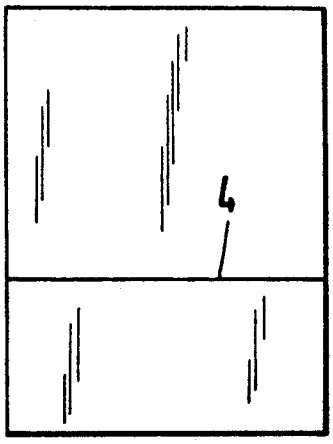
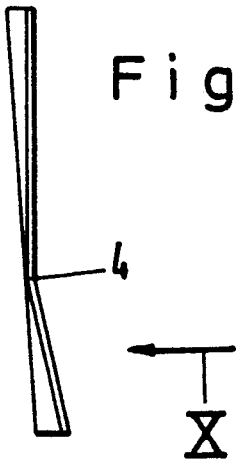
Fig.10
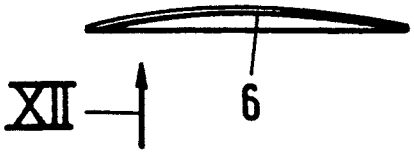
Fig.12

SEATING FURNITURE

BACKGROUND OF THE INVENTION

The invention is relating to a seating furniture with a back rest which is pivotable approximately at the height of an armrest around a horizontal axis, wherein the back rest in a side view is bent in the area of the pivoting axis and above the bend an upper part of the back rest and below the bend a lower part of the back rest is provided.

Such a seating furniture is described in French Patent 1 301 578. The bend in the profile of the back rest here is provided in such way that seen from the sitting position the lower part of the back rest is pointing away from the upper part of the back rest.

It has been found that this forced sitting position by this profile of the back rest, however, is uncomfortable, especially if one is sitting on the chair for a long period of time.

SUMMARY OF THE INVENTION

From a seating furniture with the features stated in the beginning the invention, it is a main object to provide a seat wherein the seating comfort is considerably improved by simple constructive means. The construction thus allows a person to sit longer on the seating furniture according to the invention.

For solving this object the invention is characterized in that the upper and the lower part of the back rest are separated by the pivoting axis and inclined to each other, seen from the sitting position. Additionally, the middle upper area of the upper part of the back rest and also, the middle lower are of the lower part of the back rest have a greater flexibility than the other areas of the back rest, and/or that both these areas are arched to the rear.

A person sitting upon the seating furniture according to the invention therefore can support his back very well because the profiling of the crack or pivoting axis is well adapted to the profile of the back because both parts of the back rest are inclined to each other. Moreover, particularly during a longer sitting one can easily change the sitting position because the back rest is pivotable around the horizontal axis. When pivoting the back rest, the back of the respective person is imposing a stronger pressure to the back rest, once in the upper part and once in the lower part, independent of the respective pivoting position of the back rest. This pressure is elastically intercepted by larger flexibility in the upper and the lower area of the back rest. The same effect is achieved by the arching of these areas to the rear (with a generally rigid back rest).

The substantial features according to the invention, i.e. pivotability of the back rest around a horizontal axis, bent profile of the back rest in such way that the back rest is inclined towards the respective person and larger flexibility in the upper and lower area of the back rest and the predetermined arches, respectively, are acting together in a combined manner. Also because the stated profile of the back rest in its upper and lower area, depending upon the respective pivoting position of the back rest, these areas will be subject to a stronger pressure as in the remaining areas, and the strain acting on the back rest above and below these areas will be effected or compensated for by the higher flexibility present there, in the sense of an optimal solution of the object of the invention. For example, if the user is pivoting the back rest from its normal position in such a way that the lower part of the back rest is moved toward the front, the back of the respective person will be in a more inclined position and the upper back part, having a higher flexibility is stronger yielding. If vice versa the back rest is pivoted from its normal position in such a way that the upper part of the back rest is moved front toward the lower part of the back rest because of the bend is more strongly strained but has increased flexibility and is stronger yielding. All these movements and displacements often are made involuntarily for the user and as a result it is to be noted that the sitting furniture according to the invention is distinguished by a very high sitting comfort which moreover is achieved by simple constructive means. For example, a horizontal movable sitting plane in the sitting furniture according to the invention can be eliminated if desired or may be provided in a similar way as in the cited French Patent. The sitting plane also bay be stationary.

As already mentioned, this effect can also be achieved by an arching of these areas to the rear which substantially leads to the same result as by the flexible provision of these areas.

BRIEF DESCRIPTION OF THE DRAWINGS

These and other objects and advantages of the invention will become apparent in the following detailed description in conjunction with the drawings wherein it FIG. 1—a side view of a first embodiment of a sitting furniture (chair) according to the invention;

FIG. 3—perspectively and schematically a first embodiment of a back rest;

FIG. 4—a front view of a back rest according to FIG. 3;

FIG. 5—a view in the direction of arrow V of FIG. 4;

FIG. 6—a view in direction of arrow VI of FIG. 4;

FIG. 7—a view in direction of arrow VII of FIG. 4;

FIG. 8—perspectively and a modified embodiment of the back rest which is arched in the upper and lower area;

FIG. 9—a front view of FIG. 8;

FIG. 10—a view in direction of arrow X of FIG. 9;

FIG. 11—a view in direction of arrow XI of FIG. 9 and

FIG. 12—a view in direction of arrow XII of FIG. 9.

Figure 1:
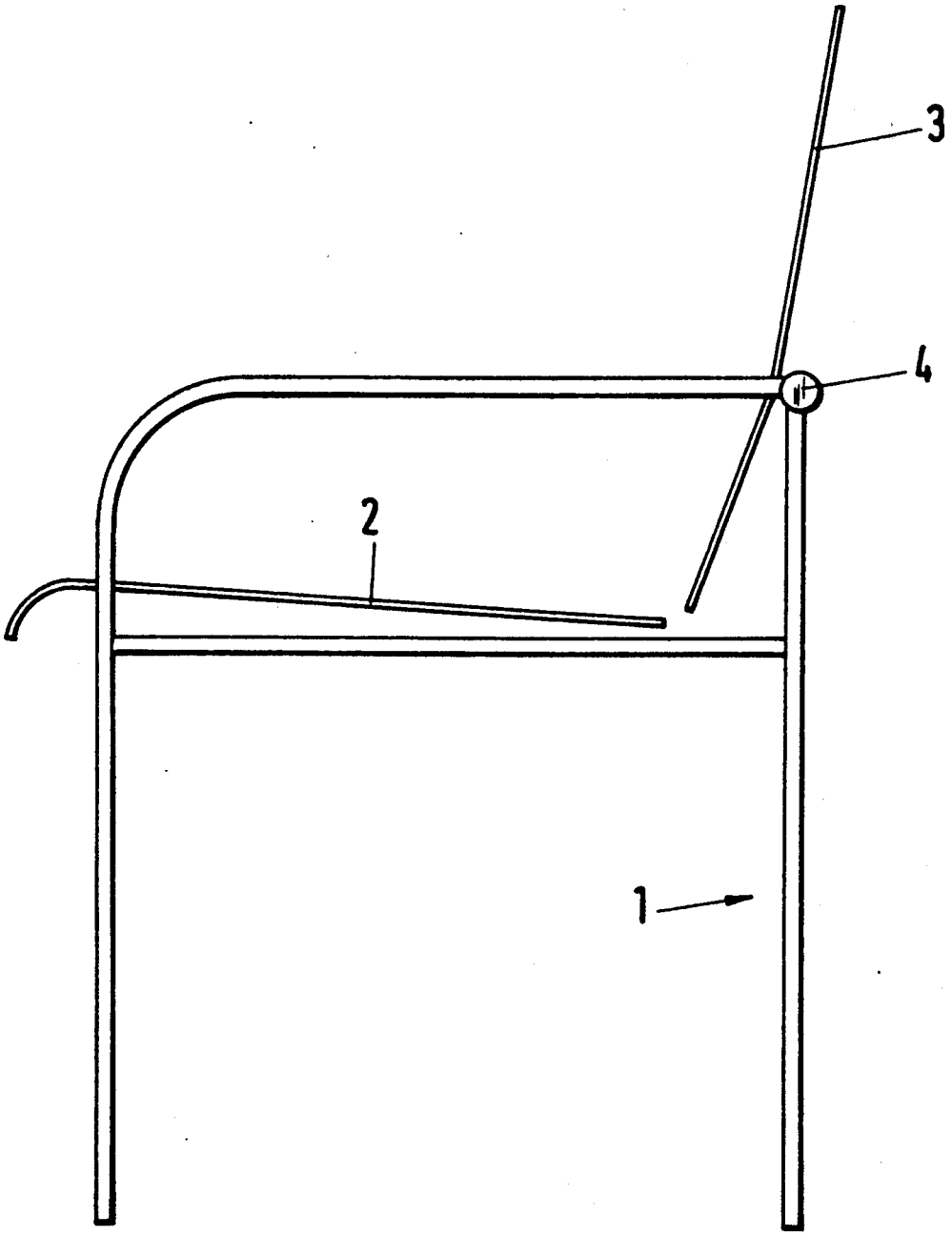
Figure 2:
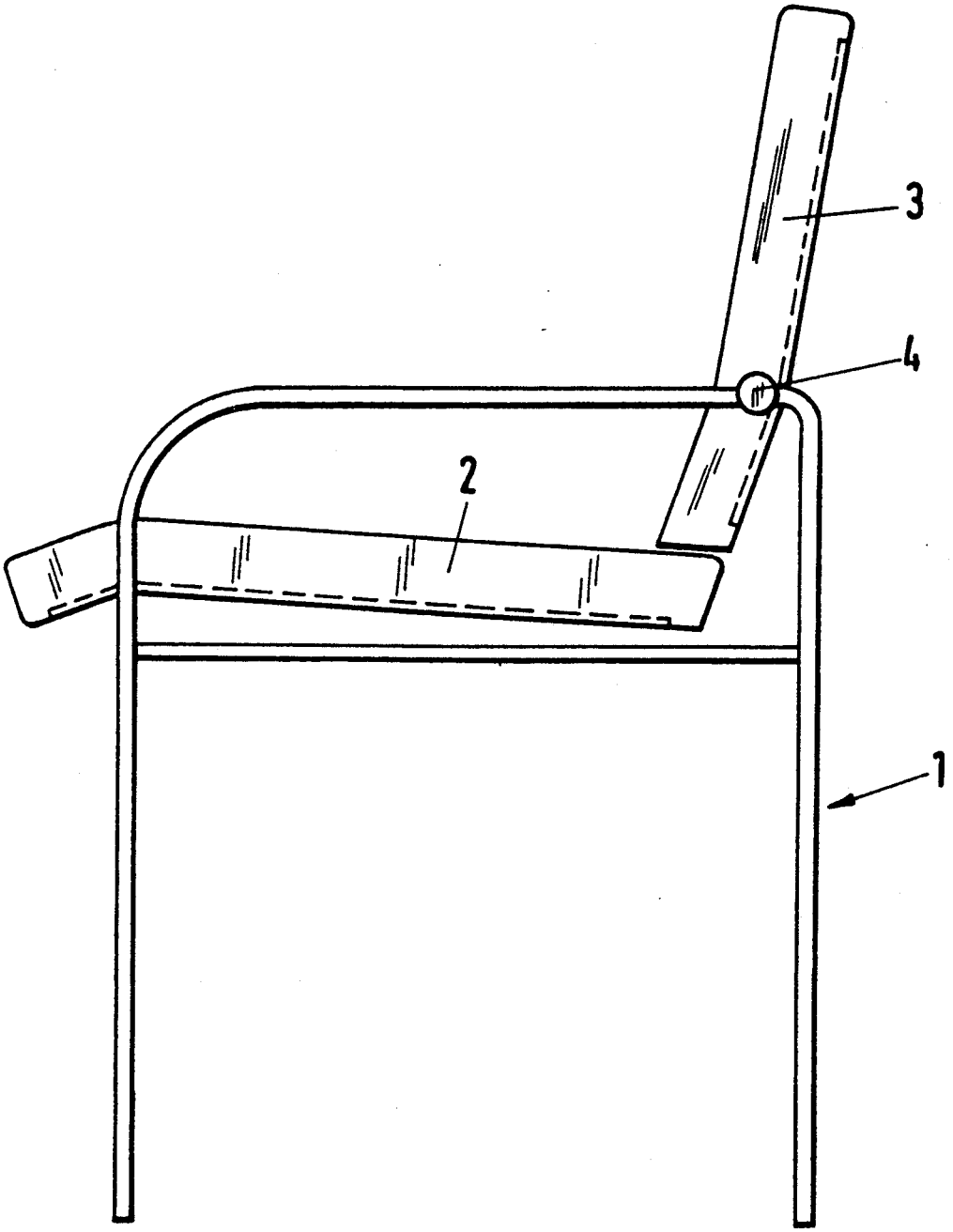
FIG. 2—a side view of an upholstered embodiment of a sitting furniture.

The chair shown in FIGS. 1 and 2 is consisting of a support 1 with a sitting plane 2 and a back rest 3. The sitting plane and the back rest are upholstered of the chair shown in FIG. 2.

According to the invention the back rest is pivotable around a horizontal axis 4. In the upholstered embodiment the axis is positioned somewhat in front of the base plate of the back rest, and in the not upholstered embodiment according to FIG. 1 same is positioned somewhat behind the back rest.

FIGS. 3 to 7 are showing a first embodiment of this back rest which is more flexible in the areas 5 and 6 as in the remaining area 7 of the back rest. This larger flexibility of areas 5, 6 is for instance achieved by several flexible bands 8 extending parallel to each other which connect the fork-like extensions of the rigid area 7 with each other. The figures also are showing that the area 5 is extending above and the area 6 is extending below the pivoting axis 4.

In the embodiment shown in FIGS. 8 to 12 the areas 5, 6 are not more flexible than the remaining area 7 of the back rest, but the areas 5, 6 are arched to the rear, as this is especially shown in FIGS. 11, 12. However, a pivoting axis 4 is also provided, and in the area of this pivoting axis a bend or kink or break is extending in such way that the part of the back rest positioned above the pivoting axis and the part of the back rest positioned below the pivoting axis is following the anatomy of the human back as these portions extend inclined to each other.

A comparison of FIGS. 1 and 2 is showing that in the upholstered embodiment of the back rest according to FIG. 2 the pivoting axis 4 is positioned in front of plate 3, i.e. is extending through the upholstery. Thereby when pivoting the back rest the relative movements between the back of the respective person and the upholstery are minimized, which otherwise could lead to a displacement of the person's clothing.

Therefore, this pivoting axis will be placed a distance from the front such that this effect is minimized.

Additionally it is mentioned that FIGS. 4–7 are showing the flexible material 8 in strained condition.

I claim:

1. Seating furniture having a back rest which is pivotable approximately at the height of an armrest around a substantially horizontal axis, comprising a back rest which is bent in the area of the pivoting axis forming an upper part and in said back rest above and below said pivoting axis respectively, the upper and lower part of the back rest being inclined to each other, and that the middle upper area of said upper part of the back rest and the middle lower area of said lower part of the back rest have a greater flexibility than the other areas of the back rest.

2. Seating furniture according to claim 1 further comprising an upholstered back rest wherein said pivoting axis is provided in front of the backward plane of the back rest.

3. Seating furniture according to claim 1, wherein said middle upper area of said upper part of the back rest and said middle lower area of said lower part of the back rest are formed to be arched toward the rear of said furniture.

4. Seating furniture having a back rest which is pivotable approximately at the height of an armrest around a substantially horizontal axis, comprising a back rest which is bent in the area of the pivoting axis forming an upper part and a lower part in the said back rest above and below said pivoting axis respectively, the upper and lower part of the back rest being inclined to each other, and that the middle upper area of said upper part of the back rest and the middle lower area of said lower part of the back rest are formed to be arched toward the rear of said furniture.

5. Seating furniture according to claim 4, further comprising an upholstered back rest wherein said pivoting axis is provided in front of the backward plane of the back rest.

* * * * *

UNITED STATES PATENT AND TRADEMARK OFFICE

CERTIFICATE OF CORRECTION

PATENT NO. : 5,018,791

DATED : May 28, 1991

INVENTOR(S) : Otto Zapf

It is certified that error appears in the above-identified patent and that said Letters Patent is hereby corrected as shown below:

On the title page, Item [30] should read

-- Foreign Application Priority Data
August 3, 1988 [DE] Fed. Rep. of Germany....3826290 --.

Signed and Sealed this

Sixth Day of April, 1993

*Attest:*

STEPHEN G. KUNIN

*Attesting Officer*

*Acting Commissioner of Patents and Trademarks*